US007218881B2

(12) United States Patent
Tanaka

(10) Patent No.: US 7,218,881 B2
(45) Date of Patent: May 15, 2007

(54) DEVELOPING APPARATUS FEATURES FIRST AND SECOND DEVELOPING MEMBERS AND IMAGE FORMING APPARATUS HAVING THE SAME

(75) Inventor: Shigeru Tanaka, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 114 days.

(21) Appl. No.: 11/157,820

(22) Filed: Jun. 22, 2005

(65) Prior Publication Data

US 2006/0008300 A1 Jan. 12, 2006

(30) Foreign Application Priority Data

Jul. 7, 2004 (JP) ..... 2004-201171

(51) Int. Cl.
*G03G 15/08* (2006.01)
*G03G 15/09* (2006.01)

(52) U.S. Cl. ..... 399/269; 399/53

(58) Field of Classification Search ..... 399/269, 399/267, 265, 149, 150, 53; 430/120, 122
See application file for complete search history.

(56) References Cited

U.S. PATENT DOCUMENTS 4,436,055 A * 3/1984 Yamashita et al. ..... 399/269
5,300,987 A * 4/1994 Aoyama et al. ..... 399/269 X
5,911,098 A * 6/1999 Gyotoku et al. ..... 399/269 X
5,923,933 A * 7/1999 Anzai et al. ..... 399/269
6,636,717 B2 * 10/2003 Itoh ..... 399/269
2006/0222415 A1 * 10/2006 Hirobe ..... 399/265

FOREIGN PATENT DOCUMENTS

JP 8-123196 5/1996
JP 11-161017 A * 6/1999

* cited by examiner

*Primary Examiner*—Sophia S. Chen
(74) *Attorney, Agent, or Firm*—Fitzpatrick, Cella, Harper & Scinto

(57) ABSTRACT

A developing apparatus provided with first and second members disposed on an upstream and downstream sides, respectively, and opposed to an image bearing member. When a closest distance between the first developing member and the image bearing member is defined as SD1 (m), and the closest distance between the second developing member and the image bearing member is defined as SD2 (m), and the peak-to-peak voltage of a developing bias applied to the first developing member is defined as V1 (V), and the peak-to-peak voltage of the developing bias applied to the second developing member is defined as V2 (V), and the volume resistivity of the carrier is $1.0\times10^{x}\Omega\cdot$cm, $$V1/SD1-V2/SD2\leqq(0.65x-4.5)\times10^{6}(\mathrm{V/m}),$$

$$1.2\times10^{6}\leqq V1/SD1\leqq(0.35x+3.5)\times10^{6}(\mathrm{V/m}),$$

$$(0.30x-1.5)\times10^{6}\leqq V2/SD2\leqq9.0\times10^{6}(\mathrm{V/m}),\text{ and}$$

$$9.0\leqq X\leqq13.0$$

are satisfied.

6 Claims, 7 Drawing Sheets

DEVELOPING APPARATUS FEATURES FIRST AND SECOND DEVELOPING MEMBERS AND IMAGE FORMING APPARATUS HAVING THE SAME

BACKGROUND OF THE INVENTION

1. Field of the Invention

The invention relates to a developing apparatus for developing a photosensitive member and having a cleaning function of removing a toner residual on the photosensitive member, and an image forming apparatus provided with this developing apparatus.

2. Description of Related Art

In image forming apparatuses such as a copying machine, a printer and a facsimile apparatus adopting an electrophotographic process, and a compound machine of these there is a case where in order to collect any untransferred toner not transferred to a transfer medium but residual on a photosensitive member, the untransferred toner is collected by a so-called "cleanerless method" of collecting the untransferred toner by a developing device without using a cleaner apparatus contacting with the photosensitive member.

When this cleanerless method is used, the untransferred toner can be recycled without being disused. Also, a frictional member does not contact with the photosensitive member and therefore, the abrasion of the photosensitive member can be prevented. Accordingly, a running cost can be reduced.

Particularly, when a two-component developing method using a developer consisting of a mixture of a toner and a magnetic carrier is used as a developing method, collectability of the untransferred toner by a magnetic brush and the re-chargeability of the collected toner are improved. Therefore, the two-component developing method is suited for the cleanerless method.

The following developing apparatus is known as an example of a developing apparatus adopting the cleanerless method.

That is, a cleaning and developing apparatus having at least two rollers disposed in opposed relationship with a photosensitive member, and using a two-component developer, wherein a roller disposed upstream with respect to the rotation direction of the photosensitive member is a cleaning roller for cleaning the photosensitive member, and a roller disposed downstream of the cleaning roller with respect to the rotation direction of the photosensitive member is a developing roller for developing an electrostatic latent image on the photosensitive member with the two-component developer (see Claim 1 and FIG. 3 of Japanese Patent Application Laid-open No. H08-123196).

This developing apparatus has disposed therein the roller given a cleaning function and the roller given a developing function, to thereby make the collectability of the untransferred toner and the developing property which are important in the cleanerless method compatible.

The developing apparatus, as shown in FIG. 7 of the accompanying drawings, makes a cleaning roller 11 and a developing roller 12 carry a two-component developer thereon, and applies predetermined biases (DCVB1+AC) and (DCVB2, respectively, thereto and therefore, is of a construction of a so-called "multi-stage developing type" which develops a latent image on a photosensitive drum 1 by the use of virtually two developing rollers.

However, the heretofore proposed cleanerless methods including the above-described conventional example have suffers from the following problems.

When a formed image includes many portions of high density, the amount of toner consumed by a developing device becomes great. Therefore, usually in the two-component developing method, a toner corresponding to the consumed amount is adapted to be sequentially supplied and thus, the amount of toner supply has also been increased. In such a case, the imparting of charges to the toner by the agitation of the two-component developer is liable to become insufficient, and in some cases, the fogging characteristic itself of the developing device has been somewhat aggravated. The aggravation of the fogging characteristic increases a fogged toner on the photosensitive member and also induces a reduction in cleaning performance.

Also, in the case of the cleanerless method having no cleaner member contacting with the photosensitive member, an increase in the toner not removed and the fogged toner has in some cases led to the vicious circle that the hindrance of charging is caused during the charging of the photosensitive member to thereby cause a further increase in fogging. Particularly, when image formation including many portions of high density has been continuously effected, such a vicious circle has often been caused.

SUMMARY OF THE INVENTION

It is an object of the present invention to provide a developing apparatus designed so as not to be reduced in cleaning performance even if the amount of consumed toner becomes great.

It is also an object of the present invention to provide an image forming apparatus which is provided with a developing apparatus designed to be not reduced in cleaning performance even if the amount of consumed toner becomes great, and which can obtain a good quality of image.

In order to achieve the above object, the developing apparatus of the present invention is provided with a first developing member and a second developing member disposed in succession from an upstream side to a downstream side with respect to the rotation direction of an image bearing member on which an electrostatic latent image is formed and in opposed relationship with the image bearing member, and applying means for applying a developing bias comprising a DC voltage and an AC voltage superimposed one upon the other to the first developing member and the second developing member, and designed such that the developing bias is applied to the first developing member and the second developing member and the electrostatic latent image is developed with a developer provided with a toner and a carrier, and the toner on the image bearing member is collected, wherein when the closest distance between the first developing member and the image bearing member is defined as SD1 (m), and the closest distance between the second developing member and the image bearing member is defined as SD2 (m), and the peak-to-peak voltage of the developing bias applied to the first developing member is defined as V1 (V), and the peak-to-peak voltage of the developing bias applied to the second developing member is defined as V2 (V), and the volume resistivity of the carrier is $1.0\times10^{X}$ (Ω·cm), $$V1/SD1-V2/SD2\leqq(0.65x-4.5)\times10^{6}(\mathrm{V/m}),$$

$$1.2\times10^{6}\leqq V1/SD1\leqq(0.35x+3.5)\times10^{6}(\mathrm{V/m}),$$

$$(0.30x-1.5)\times10^{6}\leqq V2/SD2\leqq9.0\times10^{6}(\mathrm{V/m}),\text{ and}$$

$$9.0\leqq X\leqq13.0$$

are satisfied.

In order to achieve the above object, the image forming apparatus of the present invention is provided with an image bearing member on which an electrostatic latent image is formed, a developing apparatus for toner-developing the electrostatic latent image, and transferring means for transferring the toner-developed image to a sheet, wherein the developing apparatus is the above-described developing apparatus.

These and other objects, features and advantages of the present invention will becomes more apparent upon consideration of the following description of the preferred embodiments of the present invention taken in conjunction with the accompanying drawings.

DETAILED DESCRIPTION OF THE PREFERRED EMBODIMENTS

Figure 1:
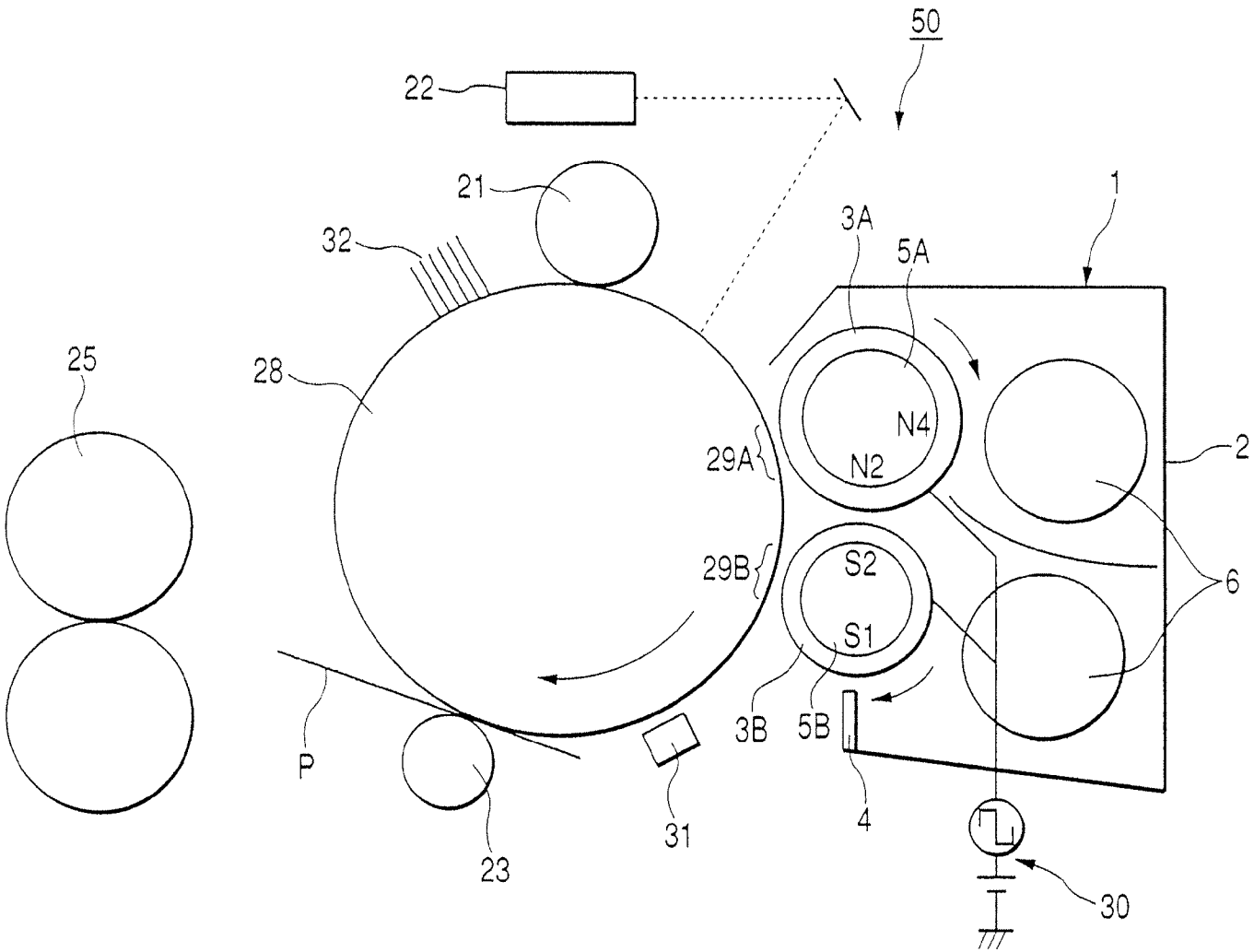
FIG. 1 is a schematic view of a copying machine as an image forming apparatus according to an embodiment of the present invention, and a developing device as a developing apparatus according to a first embodiment.

A description will hereinafter be made of a copying machine as an image forming apparatus and a developing device as a developing apparatus according to an embodiment of the present invention.

Numerical values taken up in the present embodiment are reference numerical values and the present invention is not restricted to these numerical values. Also, the numerical values are approximate numerical values and are not restricted to them.

The copying machine 50 as the image forming apparatus is provided with a primary charger 21, a laser beam scanner 22, a photosensitive drum 28, an auxiliary charging brush 32, and the developing device 1 as the developing apparatus, a transfer charger 23 and a fixing device 25. The term "image forming apparatus" covers a copying machine, a printer, a facsimile apparatus and a compound machine of these, and is not restricted to the copying machine. Also, the copying machine according to the present embodiment will be described as an example of a monochromatic copying machine, but may be a polychromatic copying machine which is provided with a plurality of developing devices 1 and forms an image of plural colors on transfer paper as a sheet.

Referring to FIG. 1, the photosensitive drum 28 is adapted to be rotated (rightwardly rotated) at a predetermined speed in a direction indicated by the arrow in FIG. 1 by a driving apparatus (not shown). The photosensitive drum 28 is of a cylindrical shape having a diameter of 60 mm. The peripheral speed of the outer peripheral surface of the photosensitive drum 28 should preferably be within a range of 50 mm/sec. to 500 mm/sec. In the present embodiment, it is 200 mm/sec. The primary charger 21 having an elastic layer on the surface layer thereof is in contact with the photosensitive drum 28. A primary charging bias is applied to the primary charger 21 by a charging bias voltage source (not shown). The primary charging bias is a bias comprising a DC component −350 to −800 V and a sine wave of a peak-to-peak voltage 1200 to 1800 V as an AC component superimposed one upon the other. The values of the DC component and the AC component are determined in accordance with the ambient temperature, humidity, etc., but herein the value of the DC component is defined as −500 V and the value of the AC component is defined as 1500 V.

The photosensitive drum 28 uniformly charged by the primary charger 21 is subjected to exposure according to image information by the laser beam scanner 22. Thereby, an electrostatic latent image according to the image information is formed on the photosensitive drum 28. A portion of the photosensitive drum which is not subjected to the exposure by the laser beam scanner 22 corresponds to a blank portion on the image, and the surface potential Vdark thereof is −500 V which is substantially the same as the DC component of the primary charging bias. Also, the portion subjected to the exposure by the laser beam scanner corresponds to a maximum density portion on the image, and the surface potential Vlight thereof varies in accordance with an exposure amount and the photosensitive characteristic of the photosensitive drum 28, but for convenience of description, it is defined as −100 V here. A medium density portion on the image is formed by time-sharing the light emitting time of the laser beam scanner 22.

The electrostatic latent image formed in this manner is developed by the developing device 1. The developing device 1 is provided with a developer container 2 containing therein a two-component developer comprising chiefly a toner and a magnetic carrier, a first developing roller 3A as a first developing member and a second developing roller 3B as a second developing member disposed in the opening portion of the developer container 2 which is adjacent to the photosensitive drum 28, in succession from the upstream side with respect to the rotation direction of the photosensitive drum, and a developing bias voltage source 30 as applying means common to the first and second developing rollers 3A and 3B.

The closest distance between the first developing roller 3A and the photosensitive drum 28 and between the second developing roller 3B and the photosensitive drum 28 is 400 μm. Each of the first developing roller 3A and the second developing roller 3B is formed of a cylindrical nonmagnetic material, and is adapted to be rightwardly rotated in the direction indicated by the arrow at a predetermined speed by a driving apparatus (not shown). Also, the diameter of the first developing roller 3A is 24.5 mm, and the diameter of the second developing roller 3B is 20 mm.

In the present embodiment, the peripheral speed ratio of the second developing roller 3B to the first developing roller 3A may preferably be within a range of 0.5 to 2.0. Also, the peripheral speed of each developing roller may preferably be within a range of 1.2 times to 4.0 times relative to the peripheral speed of the outer peripheral surface of the photosensitive drum 28. In the present embodiment, the peripheral speed of the outer peripheral surface of each of the first developing roller 3A and the second developing roller 3B is 300 mm/sec., and is 1.5 times relative to the peripheral speed of the outer peripheral surface of the photosensitive drum 28 (the peripheral speed of the photosensitive drum 28 is 200 mm/sec.) Also, the peripheral speed ratio of the second developing roller 3B to the first developing roller 3A is 1.0.

A first magnet 5A and a second magnet 5B disposed stationarity relative to the developer container 2 are contained in the interiors of the first developing roller 3A and the second developing roller 3B, respectively. Such magnetic poles as shown in FIG. 1 are disposed in the first magnet 5A and the second magnet 5B.

The two-component developer is scooped up from within the developer container 2 onto the second developing roller 3B by the magnetic force of the pole S1 of the second magnet 5B. A regulating blade 4 is provided near the pole S1 and in the developer container 2 with a predetermined gap (300 μm) kept from the surface of the second developing roller 3B. The regulating blade 4 is adapted to regulate the layer thickness of the two-component developer on the second developing roller 3B to a desired amount. The amount of the two-component developer on the second developing roller 3B after regulated is 40 mg/cm$^2$. The layer-thickness-regulated developer is conveyed by the rotation of the second developing roller 3B and the magnetic conveying force of the second magnet 5B, and contacts with the photosensitive drum 28 in a second opposed portion 29B to the photosensitive drum 28. The two-component developer passed through the second opposed portion 29B is further conveyed and is delivered from the pole S2 of the second magnet 5B to the pole N2 of the first magnet 5A. At this time, a low magnetic flux density area in which the magnetic flux density on the surface of the second developing roller 3B is approximate to 0 mT is formed in the right portion of the second magnet 5B which is between the pole S2 to the pole S1 and therefore, it never happens that the two-component developer is conveyed to that portion. That is, the two-component developer on the second developing roller 3B is all delivered to the first developing roller 3A in the pole S2 to pole N2 portion.

The two-component developer delivered to the first developing roller 3A at the pole N2 is conveyed by the rotation of the first developing roller 3A and the magnetic conveying force of the first magnet 5A, and contacts with the photosensitive drum 28 in a first opposed portion 29A to the photosensitive drum 28. At this time, the amount of the two-component developer on the second developing roller 3B is 40 mg/cm$^2$ and the peripheral speeds of the outer peripheral surfaces of the first developing roller 3A and the second developing roller 3B are the same, namely, 300 mm/sec. and therefore, the amount of the two-component developer on the first developing roller 3A is 40 mg/cm$^2$, the same as that on the second developing roller 3B. The two-component developer passed through the first opposed portion 29A is further conveyed and arrives at a pole N4. Between the pole N4 to the pole N2, there is formed a low magnetic flux density area similar to that between the pole S2 to the pole S1, and the two-component developer is stripped off from the first developing roller 3A and is collected into the developer container 2.

As described above, the two-component developer is conveyed from below to above in FIG. 1. In contrast, the surface of the photosensitive drum 28 is downwardly moved in an area opposed to the developing device 1. Thus, the directions of movement of the electrostatic latent image and the two-component developer are opposite to each other.

A developing bias is applied from a common developing bias voltage source 30 to the first developing roller 3A and the second developing roller 3B. The developing bias comprises a DC voltage component and an AC voltage component superimposed thereon. The value Vdev of the DC component is −350 V. Also, the AC voltage component is a rectangular wave having a peak-to-peak voltage of 2000 V and a frequency of 6 kHz.

The potential difference between the potential Vdark of the electrostatic latent image and the developing bias Vdev is a fogging ensuring potential and is 150 V in the present embodiment.

Description will now be made of the toner and the carrier constituting the two-component developer.

The toner used in the present embodiment is a spherical toner (polymerization toner) manufactured by a suspension polymerization method of effecting the suspension polymerization of a monomer composition comprising a styrene acryl monomer having a colorant and a charge control agent added thereto in a water medium, and the volume average particle diameter thereof is 7.5 μm. By using a toner of a spherical shape or a shape similar to a sphere, it becomes possible to greatly decrease the amount of untransferred toner, as compared with a toner of an indefinite shape manufactured by crushing classification, and this toner is very advantageous in the cleanerless method.

Also, the carrier used in the present embodiment is produced by the polymerizing method, and is a resin magnetic carrier comprising a core made of resin in which a magnetic material or a nonmagnetic metal oxide is dispersed and covered with silicone resin. The volume average particle diameter of the carrier is 40 μm, and the resistance value thereof is $1.0\times10^{12}$ Ω·cm.

Figure 2:
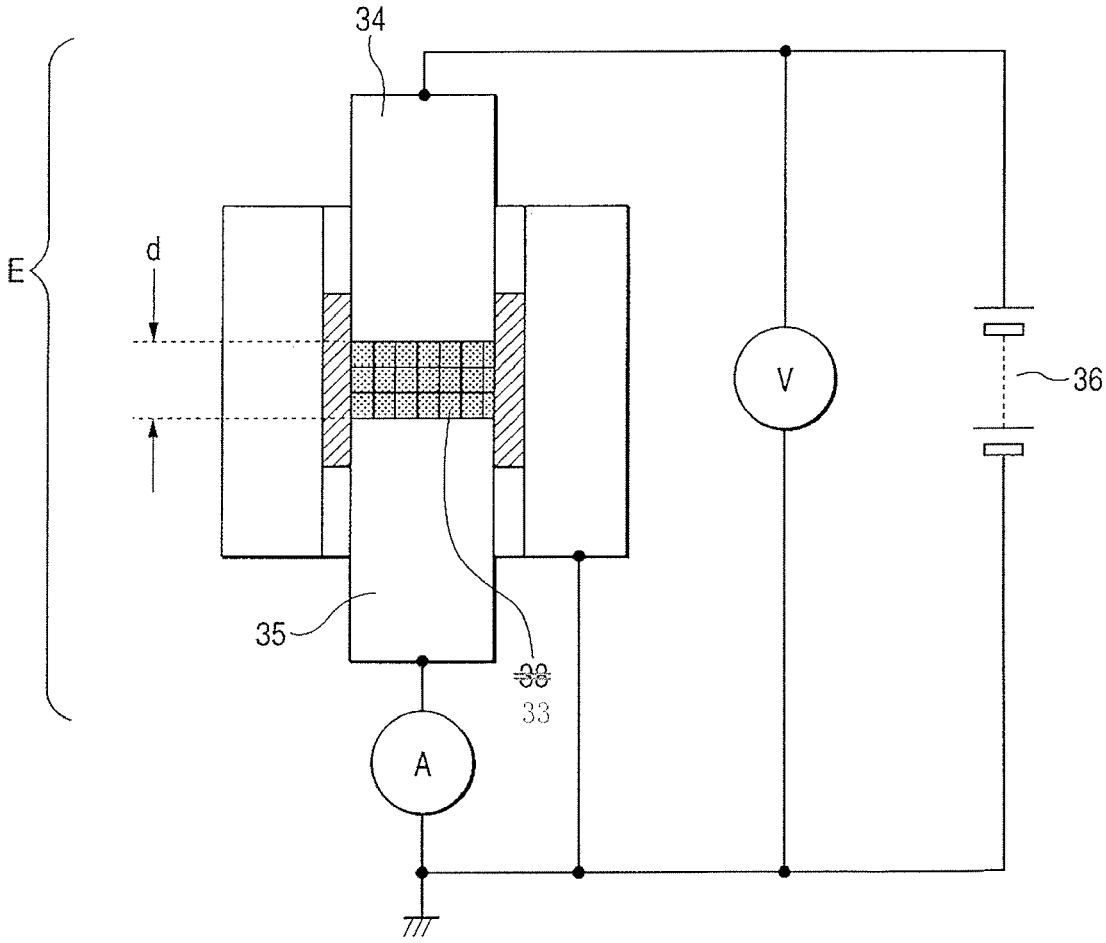
FIG. 2 is a schematic view of a carrier resistance measuring apparatus.

The resistance of the carrier was measured by the use of a measuring apparatus shown in FIG. 2. An upper electrode 34 and a lower electrode 35 are disposed in a cell E so as to contact with the carrier 33, and a predetermined voltage is applied from a voltage source 36 to between these electrodes. An electric current flowing at that time was measured to thereby find the specific resistance of the carrier. The specific resistance measuring conditions used in the present embodiment are the contact area between the filling carrier and the electrodes in about 2.3 cm$^2$, the thickness (d) is about 2 mm, the load of the upper electrode 34 is 180 g, and the intensity of a measuring electric field is $3\times10^5$ V/m; and the measuring environment is: atmospheric temperature is 23° C., and relative humidity is 50%.

Regarding the representation of the resistance value, in the present embodiment, the common logarithm of the resistance value R is X, and R is represented as $R=1.0\times10^x$. For example, a numerical value of $5.0\times10^{11}$ (mantissa 5.0, exponent 11) is about 11.7 when the common logarithm thereof is taken and therefore, when the resistance value R is $5.0\times10^{11}$ Ω·cm, this is represented as $1\times10^{11.7}$ Ω·cm.

The toner is minus-charged by the triboelectrification of the toner and the carrier.

The weight percentage (toner density) of the toner in the two-component developer is adjusted to 8% in the initial state of the installation of the developing device 1 according to the present embodiment.

The toner in the two-component developer is consumed by the development of the electrostatic latent image and the toner density is decreased. An amount of toner corresponding to the decrease is suitably supplied from a toner supplying tank (not shown) to the two-component developer in the developer container 2 in accordance with the amount of consumed toner.

The determination of the amount of toner supply from the toner supplying tank to the developer container 2 is effected by a method of measuring the quality of reflected light for a reference toner image formed by the reference latent image on the photosensitive drum 28 being developed, by an optical sensor 31. The amount of adhering toner on the reference toner image changes in accordance with the toner density of the two-component developer and therefore, how much toner consumption was done for the developing device 1, that is, an amount of toner supply required, can be determined.

The toner supplied to the developer container 2 is agitated and mixed with the two-component developer by an agitating member 6 and is subjected to triboelectrification, whereby it is given a predetermined amount of charge.

The toner image formed on the photosensitive drum 28 in the manner described above is electrostatically transferred to the surface of transfer paper P by the transfer charger 23. The transfer paper P to which the toner image has been transferred is heated and pressurized by the fixing device 25, whereby the toner image is fixed thereon. The toner image is thus permanently fixed.

An untransferred toner residual on the photosensitive drum 28 after the transfer is collected into the developing device 1 by a cleanerless method and is recycled. The collection is done in the following manner.

The toner having adhered from the developing device 1 to the surface of the photosensitive drum 28 during the development is charged to minus. This toner is transferred to the transfer paper P while receiving a bias of the plus polarity applied to the transfer charger 23 during the transfer. At this time, although slightly, particles which were plus in polarity in the toner and particles which were charged at the transferring step by the transfer charger 23 and became plus in polarity remain on the surface of the photosensitive drum 28, and these particles become the untransferred toner. Charging in the minus direction by the auxiliary charging brush 32 is first effected on this untransferred toner having the plus polarity. A DC voltage of −700V as an auxiliary charging bias is applied from a bias voltage source, not shown, to the auxiliary charging brush 32 provided with an electrically conductive brush. Since the auxiliary charging bias is of the minus polarity, the auxiliary charging brush 32 catches the untransferred toner of the plus polarity. The untransferred toner temporarily stagnates between the photosensitive drum 28 and the auxiliary charging brush 32. The untransferred toner is subjected to the charging by the auxiliary charging bias and becomes minus in polarity while it stagnates. The charge amount of the untransferred toner subjected to the auxiliary charging bias has become great in absolute value toward the minus side relative to the toner in the developing device 1. The charge amount of the untransferred toner, however, becomes on average small in absolute value by the AC component of the primary charging bias. Therefore, the untransferred toner having passed the primary charger 21 becomes substantially equal in charge amount to the toner in the developing device 1. The untransferred toner having had its charge amount regulated in this manner is stripped from the photosensitive drum 28 in the first opposed portion 29A by the scraping-off force of the two-component developer and the electric field by the AC component of the developing bias, and is moved from the surface of the photosensitive drum 28 to the first developing roller 3A by an electric force by the potential difference of Vback. In this manner, the untransferred toner is removed from the surface of the photosensitive drum 28.

The characteristic portion of the developing device according to the present embodiment will now be described in detail.

The feature of the developing device according to the present embodiment is that the cleaning performance in the cleanerless method can be maintained good even under a severe condition such as a case where images great in amount of toner consumption are continuous. That is, the developing device according to the present embodiment has the feature that it can maintain the cleaning performance good even if the amount of toner consumption is great.

As previously described, the performance of the cleanerless method depends greatly on the cleaning performance and fogging characteristic by the developing rollers 3A and 3B. If either of the cleaning performance and the fogging characteristic is bad, the amount of the toner moving round together with and on the photosensitive drum 28 (the toner resulting from the untransferred toner) will increase.

The toner moving round together, if in a predetermined amount or less, steadily exists on the photosensitive drum 28, but does not hinder the image and the cleaning performance. However, if the amount of the toner moving around together reaches such an amount as hinders the charging by the primary charger 21, the difference between Vdark and the DC component of each developing bias will be reduced and both of the cleaning performance and the fogging characteristic will be aggravated, and the amount of the toner moving around together will be further increased.

Particularly, in a case where images great in amount of toner consumption are continuously transferred to the transfer paper P, the charges imparted to the toner by agitation may become deficient due to an increase in the supplied toner. In such a case, the vicious circle as described above may be caused by the aggravation of the fogging characteristic.

That is, to stably materialize the cleanerless method, it becomes necessary to suppress the amount of the toner moving around together to a predetermined amount or less by improvements in the cleaning performance and the fogging characteristic even under a severe condition under which images great in amount of toner consumption are continuously transferred to the transfer paper P.

So, the developing device according to the present embodiment is made into a construction wherein the two-component developer is conveyed in a direction opposite to the direction of movement of the photosensitive drum 28 and the toner is consumed without fail by the second developing roller 3B, whereby particularly even when the amount of toner consumption is great, design is made such that the toner density of the two-component developer conveyed to the first developing roller 3A is lowered. If such a construction is adopted, in a case where the amount of toner consumption is great which is a condition under which the amount of the toner moving around together is liable to increase, the toner density of the two-component developer on the first developing roller 3A is automatically lowered in accordance with the degree thereof, and the cleaning performance can be improved.

To lower the toner density of the two-component developer on the first developing roller 3A, as described above, it is necessary to cause the toner to adhere to the electrostatic latent image, on the second developing roller 3B on the side which supplies the two-component developer onto the first developing roller 3A. For this purpose, it is necessary that the developing action by the first developing roller 3A become less for the electrostatic latent image and room for the toner adherence by the development by the second developing roller 3B to be effected by left. This construction will hereinafter be described with reference to FIG. 3.

Figure 3:
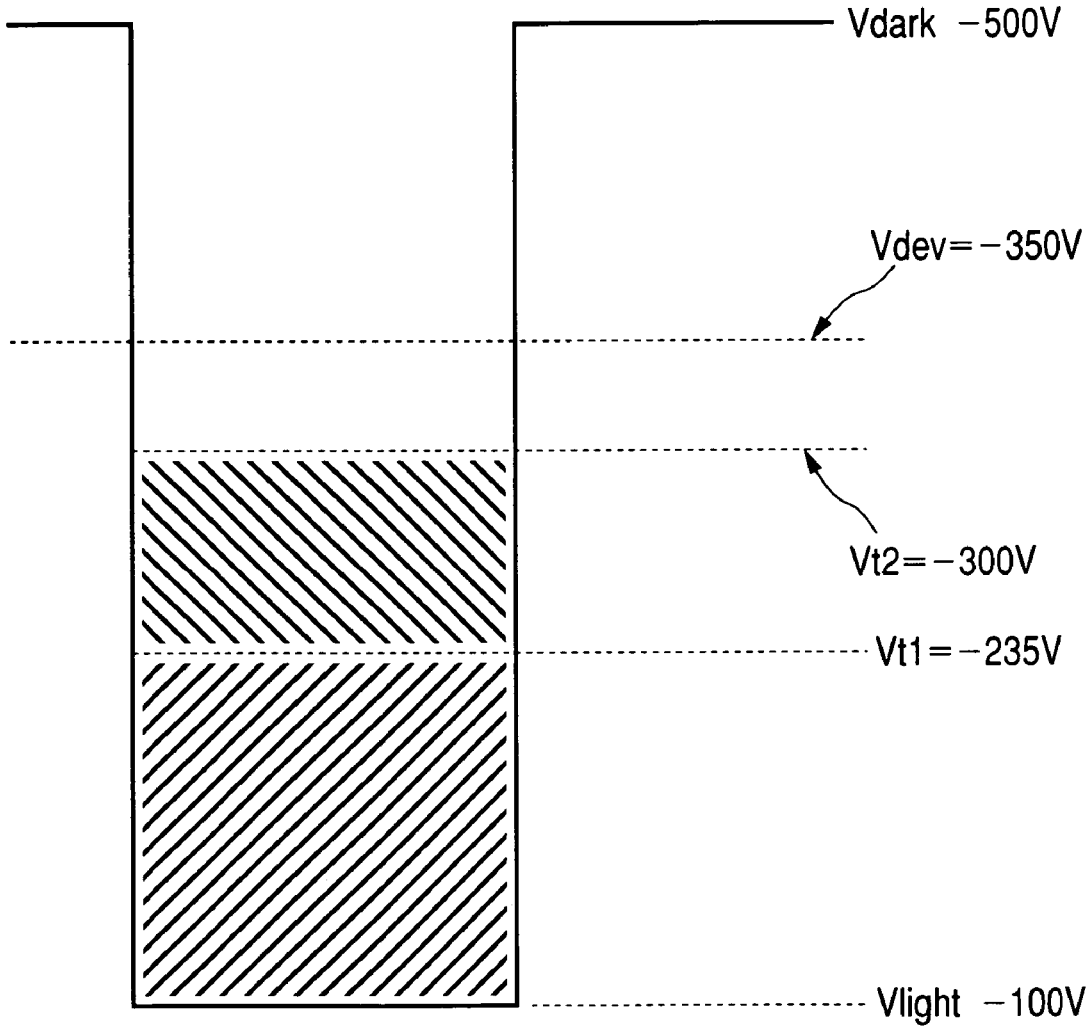
FIG. 3 illustrates the relations among the latent image potential of a photosensitive drum, the toner surface layer potential of the developing device and the DC component of a developing bias.

FIG. 3 shows the relations among the latent image surface potential Vdark and Vlight on the photosensitive drum 28, the DC component Vdev of the developing bias, the toner surface layer potential Vt1 after the completion of the development on the first developing roller 3A, and the toner surface layer potential Vt2 after the completion of the development on the second developing roller 3B.

The latent image surface potential on the photosensitive drum 28 and the toner surface layer potential are measured by a surface potential meter Model 344 produced by Trek Japan Corporation. The latent image surface potential may be measured near the upper or lower portion of the developing device 1, or may be measured with the first developing roller 3A and the second developing roller 3B experimentally removed and at the position thereof. The toner surface layer potential Vt1 is difficult to measure by an actual apparatus construction, but can experimentally be measured with the second developing roller 3B removed and by the same amount of two-component developer as in an actual operation being carried on and conveyed by the first developing roller 3A, and a measuring probe being opposed to the vicinity of the lower portion of the second developing roller 3B or the developing device 1. Also, the toner surface layer potential Vt2 can be measured by measuring the surface of the photosensitive drum 28 near the lower portion of the developing device 1.

In the first opposed portion 29A, the toner surface layer potential Vt1 immediately after the development by the first developing roller 3A has been completed is −235 V and has not yet reached −350 V which is the value of the DC component Vdev of the developing bias applied to the first developing roller 3A. This is because due to a high-resistance carrier being used, the impedance in the first opposed portion 29A is great and an electrical transitory phenomenon called the developing step is not completed ("the completion of the developing step") within the range of the first opposed portion 29A. Therefore, there is a potential difference of 115 V between the surface layer potential Vt1 of the toner image formed in the first opposed portion 29A and the DC component Vdev of the developing bias applied to the second developing roller 3B, and there remains sufficient room for effecting toner consumption on the second developing roller 3B. When for this potential difference, development is effected by the second developing roller 3B, the toner surface layer potential Vt2 becomes −300 V, that is, an amount of toner corresponding to 65 V in terms of the toner surface potential has adhered onto the photosensitive drum 28, and this shows that the toner consumption by the second developing roller 3B has been sufficiently effected.

The two-component developer having had its toner consumed by the second developing roller 3B in this manner is conveyed to the first developing roller 3A, and development and the cleaning step are effected in the first opposed portion 29A.

Regarding the cleaning performance, the untransferred toner collecting capability of the two-component developer is enhanced by the toner density being lowered. This is because by the toner density being lowered, an area which can receive the untransferred toner is increased on the carrier surface in the two-component developer.

This action becomes remarkable particularly when an image great in amount of toner consumption is formed and therefore, even under a severe condition such as a case where images great in amount of toner consumption are continuous, the cleaning performance in the cleanerless method can be maintained good.

The effect of the high-resistance carrier in the present embodiment will be described here in detail.

The "completion of the developing step" described above can be expressed by the use of an index called "latent image charging rate" as will be described below. The latent image charging rate is represented by the ratio of the potential difference (Vlight−Vt) formed by the developed toner image to the latent image contrast potential (Vlight−Vdev). That is, the latent image charging rate can be represented as the latent image charging rate=(Vlight−Vt)/(Vlight−Vdev).

The "completion of the developing step" shows that this latent image charging rate converges to a predetermined value (Vdev) in accordance with an exponential function, and substantially becomes 100%. That is, the fact that the developing step is not complete in a system using the high-resistance carrier like the present embodiment shows that the above-mentioned latent image charging rate has not yet reached 100%.

The time constant of the above-mentioned exponential function depends on the impedance between the photosensitive drum 28 and the developing roller 3A and between the photosensitive drum 28 and the developing roller 3B. When this impedance is high, the time constant becomes great, and much time is required until the phenomenon is saturated. Conversely, when the impedance is low, the time constant becomes small, and the time until the phenomenon is saturated becomes short.

Figure 4:
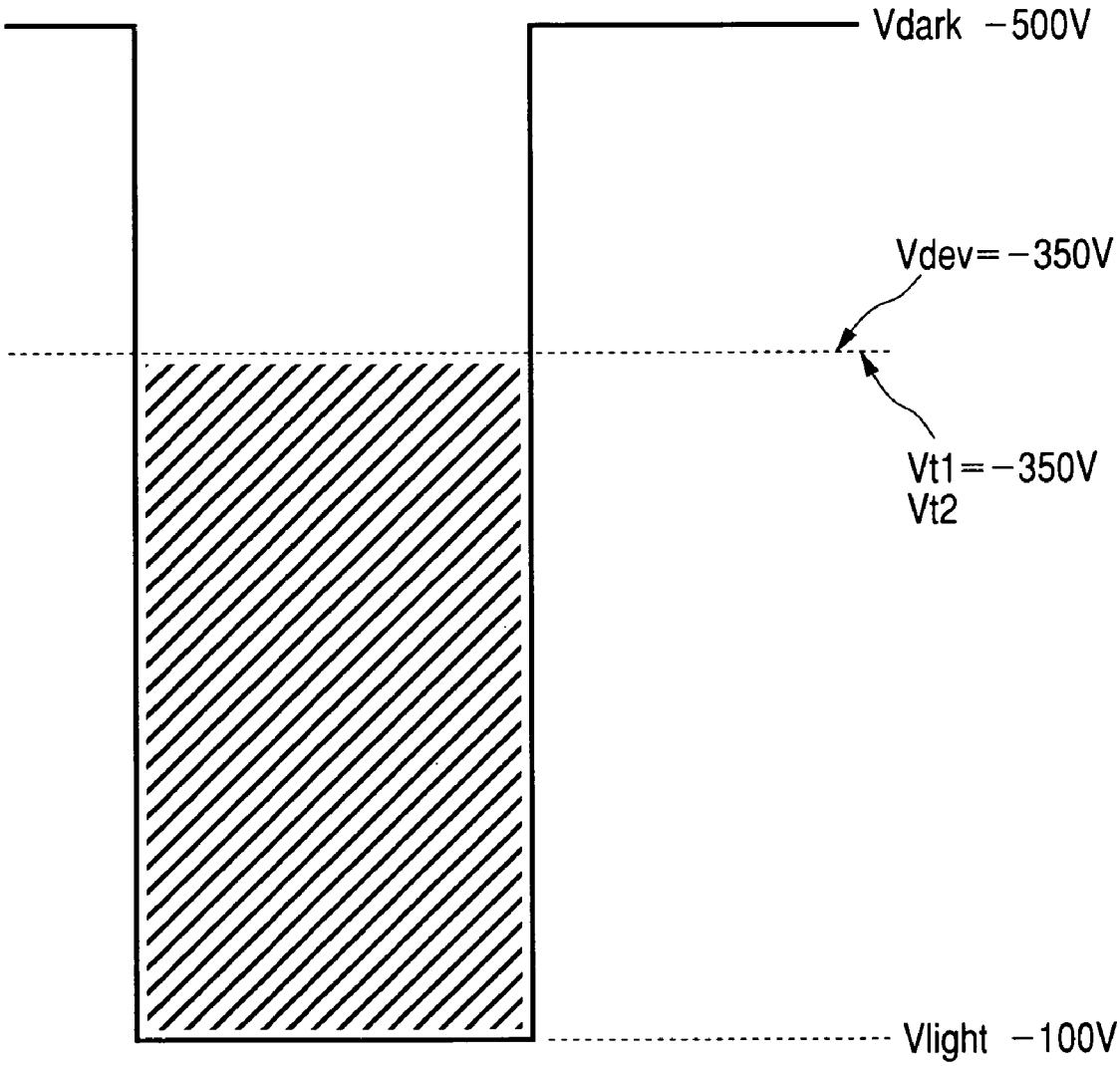
FIG. 4 shows the relations among the latent image surface potential on the photosensitive drum when the resistance value as a carrier is $1.0\times10^7\Omega\cdot$cm, the DC component Vdev of the developing bias, and toner surface layer potential Vt1 and Vt2 after the completion of development on a first developing roller and a second developing roller.

FIG. 4 shows as a comparative example the relations among the latent image surface potential on the photosensitive drum 28, the DC component Vdev of the developing bias and the toner surface layer potential Vt1 and Vt2 after the completion of the development on the first developing roller 3A and the second developing roller 3B in a case where the resistance value as the carrier is $1.0\times10^7$ Ω·cm.

It is when for example, an electrically conductive substance is much contained in the core of a resin carrier or when ferrite is used as the core of the carrier that the resistance of the carrier becomes $1.0\times10^7$ Ω·cm.

In the first opposed portion 29A, the toner surface layer potential Vt1 immediately after the development by the first developing roller 3A becomes −350 V, which is substantially the same as −350 V which is the value of the DC component Vdev of the developing bias applied to the first developing roller 3A. This is because as compared with the high-resistance carrier as in the present embodiment, the impedance in the first opposed portion 29A is small, and there is an electrical transitory phenomenon called the developing step, but the time constant is small for the system of the present embodiment and therefore, the phenomenon is substantially instantaneously saturated. That is, this means that when use is made of a carrier having a resistance value of $1.0\times10^7$ Ω·cm, the latent image charging rate reaches 100% by the development by the first developing roller 3A.

Therefore, a potential difference cannot be formed between the surface layer potential Vt1 of the toner image formed in the first opposed portion 29A and the DC component Vdev of the developing bias applied to the second developing roller 3B, and there is no room for effecting toner consumption on the second developing roller 3B. Therefore, when the resistance value of the carrier is $10^7$ Ω·cm, an effect like that of the present embodiment cannot be obtained.

In order that as in the present embodiment, the toner may be consumed without fail by the second developing roller 3B, it is necessary to use a carrier having a resistance value of $1.0\times10^{9}$ Ω·cm or greater.

However, if the resistance value of the carrier exceeds $1.0\times10^{13}$ Ω·cm, the aggravation of the developing characteristic will become remarkable and it will become difficult to obtain desired image density although an effect like that of the present embodiment will be obtained. Also, collaterally with the aggravation of the developing characteristic, a phenomenon called "edge enhancement" meaning that the toner adheres excessively to the edge portion of the latent image and the density thereof becomes high is aggravated, and this is not preferable.

Therefore, it is necessary that the resistance value of the carrier used in the present embodiment be within a range of $1.0\times10^{9}$ Ω·cm to $1.0\times10^{13}$ Ω·cm.

That is, when as previously described, the common logarithm of the resistance value R of the carrier is defined as X, it is necessary that $$9.0 \leqq X \leqq 13.0 \quad (1)$$

be materialized.

A description will be further made of various conditions for suitably obtaining the effect of the present invention.

Figure 5:
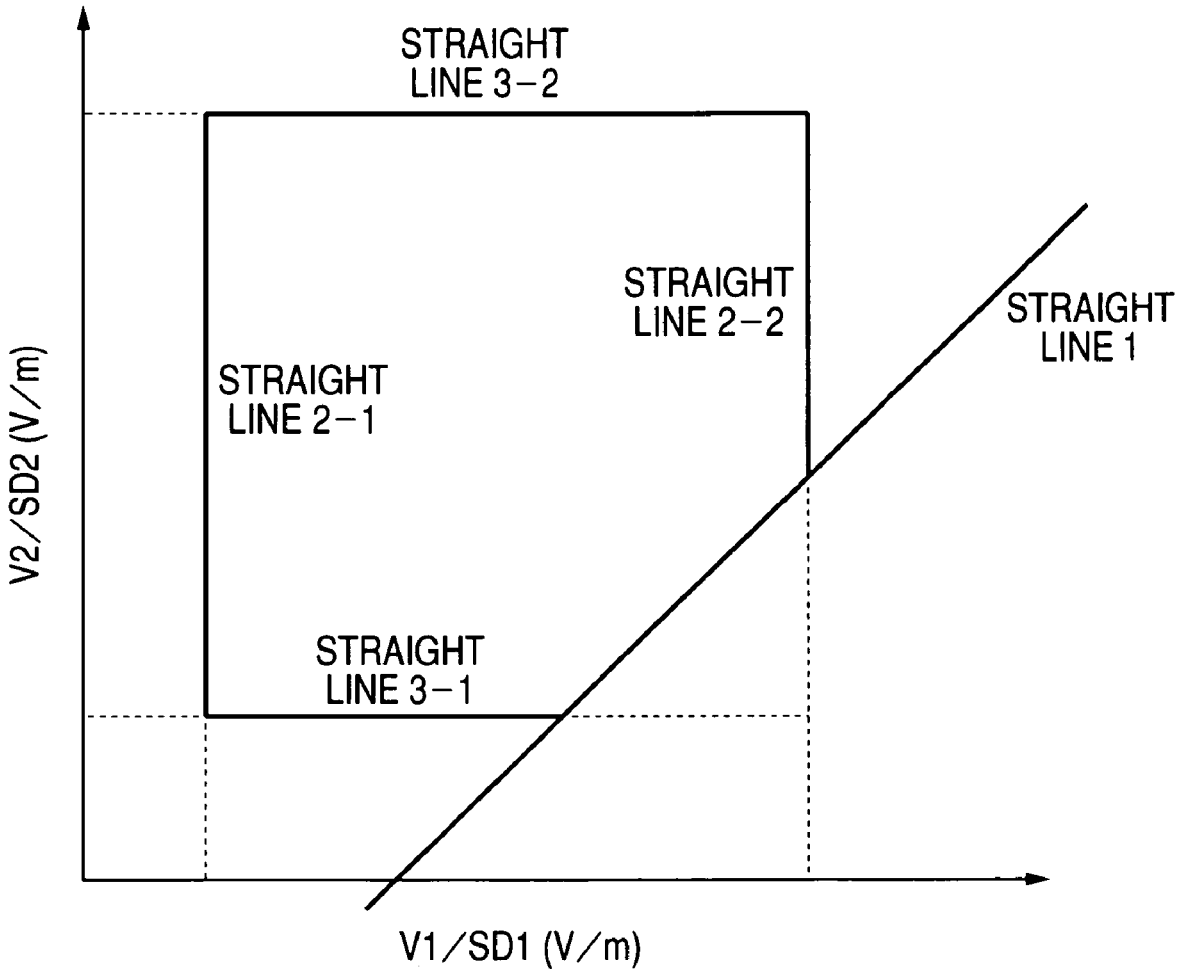
FIG. 5 shows the relative relations between AC electric fields applied to among the first developing roller, the second developing roller and the photosensitive drum.

FIG. 5 shows the relative relation of an AC electric field applied to between the first developing roller 3A and the photosensitive drum 28 and between the second developing roller 3B and the photosensitive drum 28 which shows the feature of the present embodiment. The values of these electric fields are indicated on the axis of abscissas and the axis of ordinates.

A first necessary condition for suitably obtaining the action of the present embodiment is that when the closest distance between the first developing roller 3A and the photosensitive drum 28 is defined as SD1 (m), and the closest distance between the second developing roller 3B and the photosensitive drum 28 is defined as SD2 (m), and the peak-to-peak voltages of the AC components of the bias voltages applied to the first developing roller 3A and the second developing roller 3B are defined as V1 (V) and V2 (V), respectively, and the volume resistivity of the aforementioned magnetic carrier is $1.0\times10^{x}$ (Ω·cm), $$V1/SD1 - V2/SD2 \leqq (0.65x-4.5)\times10^{6}(\text{V/m}) \quad (2)$$

is satisfied.

Regarding expression (2), if the value of V1/SD1−V2/SD2 exceeds $(0.65x-4.5)\times10^{6}$ (V/m) (an area rightwardly below a straight line 2 indicative of expression (2) in FIG. 5), the developing capability of the first developing roller 3A for the electrostatic latent image will become high and the developing capability of the second developing roller 3B for the electrostatic latent image will be decreased, and this leads to the undesirable possibility that the toner consuming effect by the second developing roller 3B may be hindered and it becomes impossible to sufficiently obtain the effect of the present invention.

As shown in expression (2), this relative relation is varied by the resistance value of the carrier, and the greater is the value of X, the more greatly can be set V1/SD1 and the smaller can be set V2/SD2. That is, the greater is the resistance value of the carrier, the more easily can be obtained the toner consuming effect by the second developing roller which is the characteristic effect of the present invention.

Next, a second necessary condition for suitably obtaining the action of the present embodiment is that each of V1/SD1 and V2/SD2 is within an optimum range. The condition is as follows:

$$1.2\times10^{6} \leqq V1/SD1 \leqq (0.35x+3.5)\times10^{6}\ (\text{V/m}) \quad (3)$$

$$(0.3x-1.5)\times10^{6} \leqq V2/SD2 \leqq 9.0\times10^{6}\ (\text{V/m}) \quad (4)$$

Expression (3) relates to the AC electric field applied to the first developing roller 3A.

If V1/SD1 is below $1.2\times10^{6}$ (V/m) (an area on the left side of a straight line 2-1 indicative of the left side of expression (3) in FIG. 5), the toner stripping capability for the untransferred toner by the AC electric field will not be obtained in the first opposed portion 29A between the first developing roller 3A and the photosensitive drum 28, and this leads to the undesirable possibility that the cleaning performance on the first developing roller 3A may not be sufficiently obtained.

Also, if V1/SD1 exceeds $(0.35x+3.5)\times10^{6}$ (V/m)(an area on the right side of a straight line 2-2 indicative of the right side of expression (3) in FIG. 5), the developing capability of the first developing roller 3A for the electrostatic latent image will be enhanced and the toner consuming effect by the second developing roller 3B will be hindered, and this leads to the undesirable possibility that the effect of the present invention cannot be sufficiently obtained.

As shown in the right side of expression (3), the upper limit value of V1/SD1 is varied by the resistance value of the carrier. When the resistance value of the carrier is high, the degree to which the developing capability of the first developing roller 3A for the electrostatic latent image is enhanced is small and therefore, it is relatively difficult for the toner consuming effect by the second developing roller 3B to be hindered. Therefore, it is possible to set the AC electric field applied to the first developing roller 3A to a great level to thereby enhance the cleaning effect.

Expression (4) relates to the AC electric field applied to the second developing roller 3B.

If V2/SD2 is below $(0.30x-1.5)\times10^{6}$ (V/m) (an area below a straight line 3-1 indicative of the left side of expression (4) in FIG. 5), the developing capability of the second developing roller 3B for the electrostatic latent image will be decreased and the toner consuming effect by the second developing roller 3B will be hindered, and this leads to the undesirable possibility that the effect of the present invention cannot be sufficiently obtained.

As shown in the left side of expression (4), the lower limit value of V2/SD2 is varied by the resistance value of the carrier. When the resistance value of the carrier is high, the developing capability of the second developing roller 38 for the electrostatic latent image is liable to be decreased and the toner consuming effect by the second developing roller 3B becomes liable to be hindered and therefore, it is necessary to set the AC electric field applied to the second developing roller 3B to a relatively great level.

Also, if V2/SD2 exceeds $9.0\times10^{6}$ (V/m) (an area above a straight line 3-2 indicative of the right side of expression (4) in FIG. 5), insulation destruction may occur in the opposed portion between the first developing roller 3A and the photosensitive drum 28 to thereby spoil the image forming function, and this is not preferable.

Further, to suitably obtain the effect of the present invention, it is preferable that design be made such that when the values of the DC components of the bias voltages applied to the first developing roller 3A and the second developing roller 3B are made the same, and when the surface potential of the maximum density portion of the electrostatic latent image is defined as Vlight (V), and the toner surface layer potential on the latent image bearing member after the maximum density portion of the electrostatic latent image has been developed by the first developing roller 3A is defined as Vt1 (V), and the toner surface layer potential on the latent image bearing member after the aforementioned maximum density portion has been developed by the second developing roller 3B is defined as Vt2 (V), $$0.15 \leqq (Vt2-Vt1)/(Vt2-Vlight) \leqq 0.50 \quad (5)$$

is satisfied.

In expression (5), (Vt2−Vlight) represents the surface potential difference by the toner used to develop by the entire developing device according to the entire developing device according to the present embodiment, and (Vt2−Vt1) represents the surface potential difference by the toner used to develop by the second developing roller 3B. In the multi-stage developing device like the present embodiment using two-component contact AC development, the charge amount per weight of the toner used to develop on each developing roller may be considered to be substantially constant and therefore, this value indicates the percentage of the amount used to develop by the second developing roller 3B, of the toner used to develop.

The aforedescribed construction of the present embodiment is a construction in which the value of (Vt2−Vt1)/(Vt2−Vlight) is substantially 0.15 or greater, and when this is below 0.15, there is the undesirable possibility that the toner consuming effect by the second developing roller 3B becomes deficient and the effect of the present invention cannot be sufficiently obtained.

Also, within the range of the aforedescribed construction of the present embodiment, it is considered that (Vt2−Vt1)/(Vt2−Vlight) does not substantially exceed 0.50. Supposing a case where this value exceeds 0.50, it shows a condition under which the toner consuming effect by the second developing roller 3B is sufficiently obtained, but conversely the developing property by the first developing roller 3A is too low. As previously described, in the construction of the present embodiment, such a condition under which the developing performance of the first developing roller 3A is low tends to decrease the cleaning performance of the first developing roller 3A at the same time, and therefore is not preferable.

The method of measuring Vlight (V), Vt1 (V) and Vt2 (V) has already been described.

Also, in the present embodiment, it is preferable that design be made such that the aforementioned SD1, SD2, V1 and V2 are as follows:

$$0.2\times10^{-3}\ (m) \leqq SD1 \leqq 1.0\times10^{-3}\ (m) \quad (6)$$

$$0.2\times10^{-3}\ (m) \leqq SD2 \leqq 1.0\times10^{-3}\ (m) \quad (7)$$

$$500\ (V) \leqq V1 \leqq 3000\ (V) \quad (8)$$

$$500\ (V) \leqq V2 \leqq 3000\ (V) \quad (9)$$

Regarding the expressions (6) and (7), if SD1 and SD2 are below $0.2\times10^{-3}$ (m), the possibility of the stagnation of the developer in the opposed portions between the developing rollers and the photosensitive drum occurring will become great, and the possibility that the electric field in the opposed portions by the bias voltage strengthens to thereby cause insulation destruction will become great, and this is not preferable. Also, if SD1 and SD2 exceed $1.0\times10^{-3}$ (m), the possibility that the contact of the developing rollers with the photosensitive drum 28 weakens to thereby decrease the cleaning performance and the developing performance will become great, and this is not preferable.

Regarding the expressions (8) and (9), if V1 and V2 are below 500 (V), the possibility of the reductions in the cleaning performance and the developing performance due to the weakening of the AC electric field in the opposed portion between the developing roller and the photosensitive drum 28 will become great, and this is not preferable. Also, if V1 and V2 exceed 3000 (V), the possibility of the insulation destruction due to the strengthening of the electric field in the opposed portion caused by the bias voltage will become great, and this is not preferable.

Second Embodiment

Developing Device According to the Second Embodiment

The developing device according to this embodiment is one in which the AC bias waveform in the developing device according to the first embodiment has been changed. The AC component of a developing bias in the present embodiment, as shown in FIG. 6, in a blank pulse waveform of a construction which repeats the action of generating a rectangular wave having a frequency of 8 kHz and a peak-to-peak voltage of 1.8 kV by an amount corresponding to two cycles, and thereafter discontinuing it by an amount corresponding to two cycles.

Figure 6:
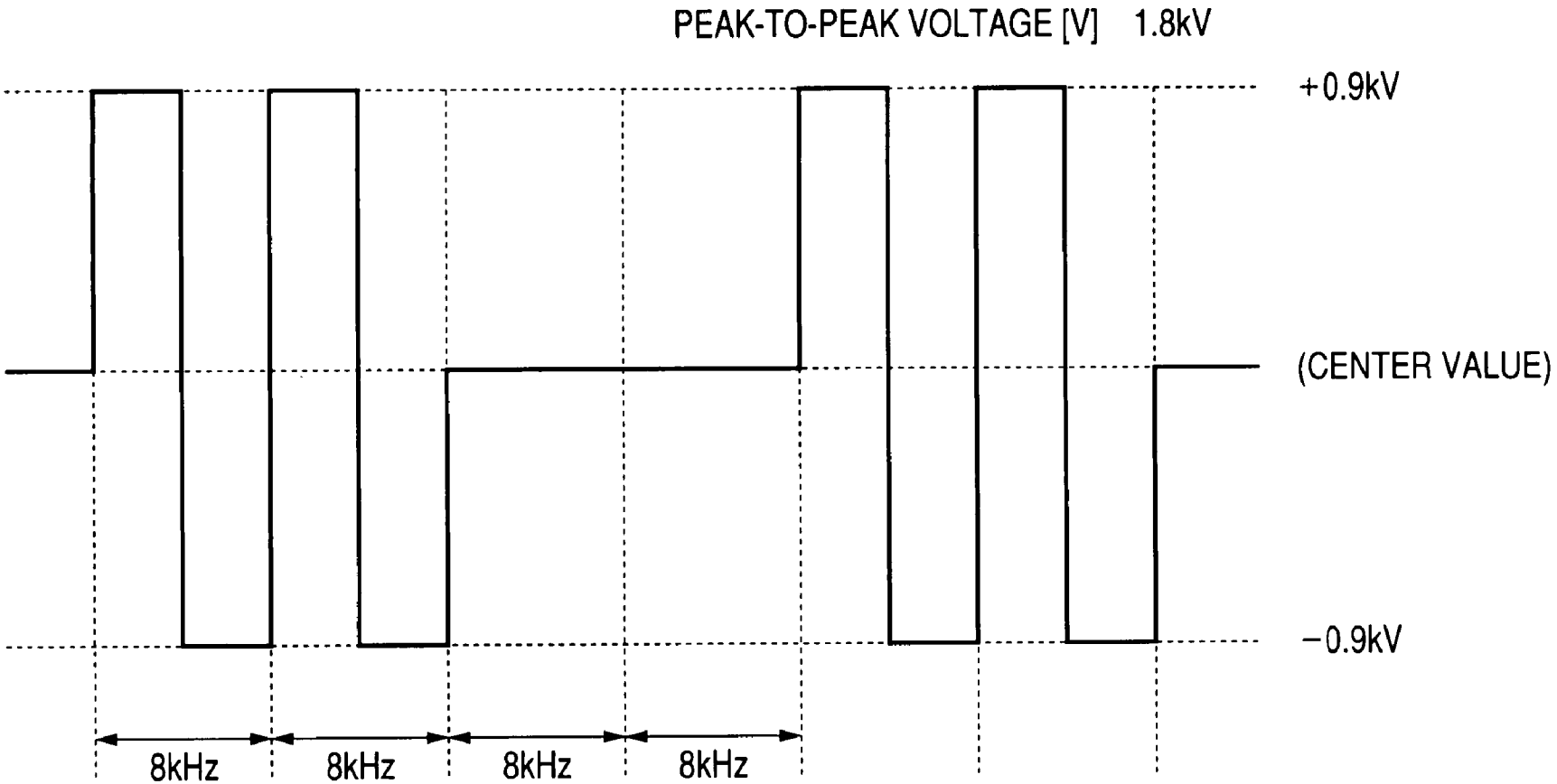
FIG. 6 shows the blank pulse waveform of the developing bias of a developing device according to a second embodiment.
Figure 7:
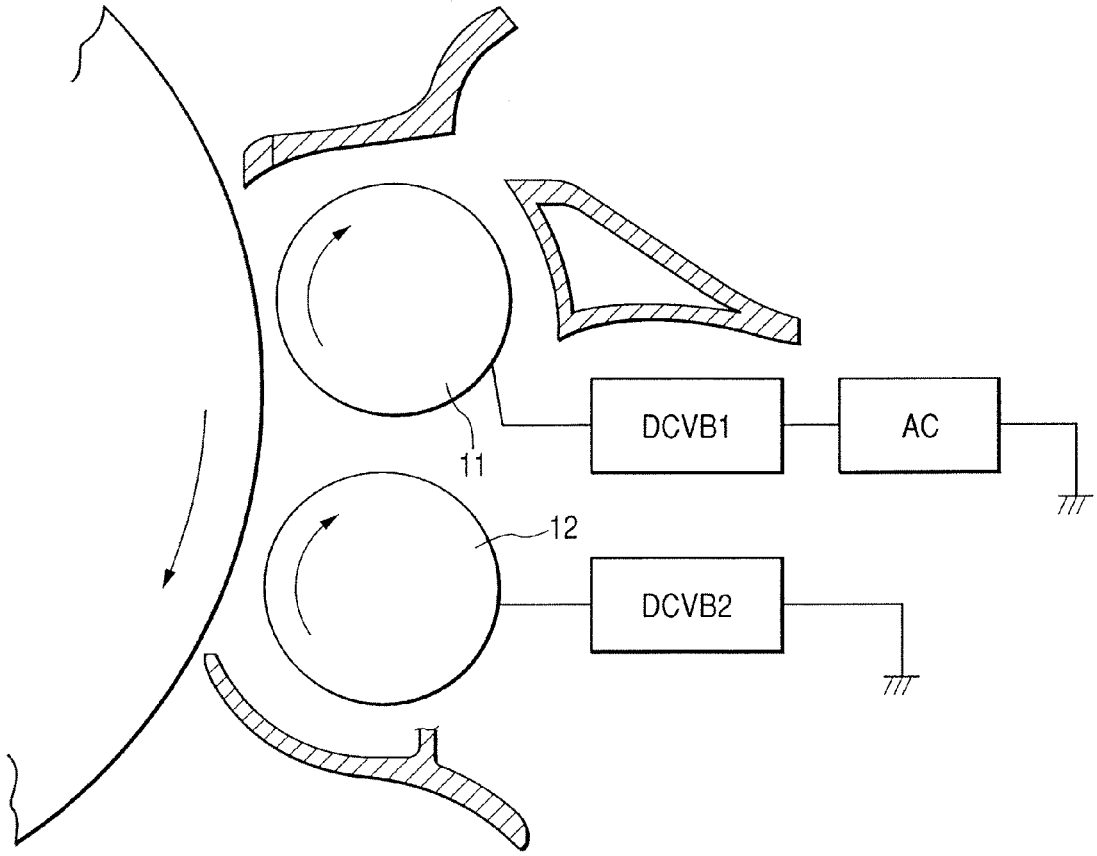
FIG. 7 PRIOR ART
FIG. 7 is a schematic view of a conventional developing apparatus.

In the present embodiment, design is made such that a constant voltage and the DC component of the developing bias when being discontinued by an amount corresponding to two cycles in FIG. 6 coincide with each other. This is because the AC component of the developing bias in the present embodiment is symmetrical with respect to the constant voltage when the AC component is being discontinued by an amount corresponding to two cycles.

In the present invention, however, the AC waveform of the developing bias is not always restricted to a vertically symmetrical one, and particularly in a case where the AC waveform is not vertically symmetrical in a waveform provided with a discontinued portion as in the present embodiment, a voltage value set as the discontinued portion and the value of the DC component of the developing bias do not always coincide with each other.

As previously described, the potential difference between the potential Vdark of the electrostatic latent image and the developing bias Vdev is called Vback (fogging ensuring potential), and in the present embodiment, it is 150V. When this Vback has become small relative to a center set value, fogging gradually increases in accordance therewith. Here, when the blank pulse waveform in the present embodiment is used as the developing bias, the tendency of fogging increasing from its minimum state can be made small, as compared with a case where use is made of a rectangular wave like that in the first embodiment. That is, even when Vback has become small due to faulty charging by the primary charger 21 resulting from the faulty collection of the untransferred toner, the degree of aggravation of fogging is small as compared with the first embodiment. Therefore, the effect of the present invention can be obtained more effectively, and this is preferable.

While the embodiments of the present invention have been described above, the detailed construction of the present invention is not always restricted to these embodiments, but can assume various forms within a scope in which the objects of the present invention can be suitably attained. Of course, it is also possible to suitably combine and use the methods of the above-described embodiments, and in view of various conditions, the condition can be adjusted so that the effect of the present invention may be appropriately obtained.

For example, the magnetic pole arrangement of the two-component developer delivering and receiving portion between the developing rollers as described above is not restricted to a different pole arrangement, but the same poles may be arranged.

For example, regarding the method of determining the amount of toner supply, as there have heretofore been made various propositions, there are a method of detecting toner density by an optical sensor or a permeability sensor in the developer container 2, a method of detecting the amount of toner consumption by image information or the light emission frequency of the laser beam scanner 22, etc. Use may be made of any method including the methods mentioned in the embodiments, or a combination of those methods. Any method adopted is similar in that when an image of high image density or a high area rate is taken, the amount of toner supply increases in accordance therewith.

Also, regarding the transfer of the toner image from the photosensitive drum 28, it is known that the use of an intermediate transfer belt of which the physical properties can be designed under a predetermined condition is more stable and can more decrease the amount of untransferred toner than to transfer paper having various physical property values, and therefore this method may also be used.

Further, it is also possible to make the developing biases applied to the first developing roller 3A and the second developing roller 3B discrete from each other, and set the fogging and the amount of toner consumption by the first developing roller 3A so that the effect of the present invention may be easily provided. In this case, however, the necessity of individually disposing the developing bias voltage sources occurs and the potential difference (particularly the AC component) between the first developing roller 3A and the second developing roller 3B occurs and therefore, it becomes necessary to separately provide a countermeasure for the leak between the first developing roller 3A and the second developing roller 3B, and this results in the complication of the construction and is therefore not preferable.

The copying machine 50 according to the present embodiment is provided with the developing device 1 which may be great in the amount of toner construction but is not reduced in the cleaning performance, and can therefore form a good quality of image on the transfer paper.

The developing apparatus according to an embodiment of the present invention is designed such that even though the amount of toner consumption may be great, lastly the toner is consumed on the second developing member opposed to the electrostatic latent image on the image bearing member and therefore, the density of the toner first conveyed to the first developing member opposed to the electrostatic latent image on the image bearing member is automatically lowered, and the cleaning performance is hardly reduced.

The image forming apparatus according to an embodiment of the present invention is provided with the developing apparatus which may be great in the amount of toner consumption but is not reduced in the cleaning performance, and can therefore form a good quality of image on a sheet.

While the invention has been described with reference to the structure disclosed herein, it is not confined to the details set forth and this application is intended to cover such modifications or changes as may come within the purpose of the improvements or the scope of the following claims.

This application claims priority from Japanese Patent Application No. 2004-201171 filed on Jul. 7, 2004, which is hereby incorporated by reference herein.

What is claimed is:

1. A developing apparatus comprising:

a first developing member and a second developing member disposed in succession from an upstream side to a downstream side with respect to a rotation direction of an image bearing member on which an electrostatic image is formed and in opposed relationship with said image bearing member; and applying means for applying a developing bias comprising a DC voltage and an AC voltage superimposed one upon the other to said first developing member and said second developing member, wherein the developing bias is applied to said first developing member and said second developing member and the electrostatic image is developed with a developer including a toner and a carrier, and the toner on the image bearing member is collected, and wherein when a closest distance between said first developing member and the image bearing member is defined as SD1 (m), and a closest distance between said second developing member and the image bearing member is defined as SD2 (m), and a peak-to-peak voltage of the developing bias applied to said first developing member is defined as V1 (V), and a peak-to-peak voltage of the developing bias applied to said second developing member is defined as V2 (v), and a volume resistivity of the carrier is defined as $1.0\times10^{x}$ (Ω·cm), $$V1/SD1-V2/SD2\leqq(0.65x-4.5)\times10^{6}(\mathrm{V/m}),$$

$$1.2\times10^{6}\leqq V1/SD1\leqq(0.35x+3.5)\times10^{6}(\mathrm{V/m}),$$

$$(0.30x-1.5)\times10^{6}\leqq V2/SD2\leqq9.0\times10^{6}(\mathrm{V/m}),\text{ and}$$

$$9.0\leqq X\leqq13.0$$

are satisfied.

2. A developing apparatus according to claim 1, wherein when DC component values of the developing bias applied to said first developing member and said second developing member are the same, and when a surface potential of a maximum density portion of the electrostatic image is defined as Vlight (V), and a toner surface layer potential on the image bearing member after the maximum density portion of the electrostatic image has been developed by said first developing member is defined as Vt1 (V), and a toner surface layer potential on the image bearing member after the maximum density portion has been developed by said second developing member is defined as Vt2 (V), $$0.15\leqq(Vt2-Vt1)/(Vt2-V\mathrm{light})\leqq0.50$$

is satisfied.

3. A developing apparatus according to claim 1 or 2, wherein SD1, SD2, V1 and V2 satisfy:

$$0.2\times10^{-3}(m)\leqq SD1\leqq1.0\times10^{-3}\ (m),$$

$$0.2\times10^{-3}(m)\leqq SD2\leqq1.0\times10^{-3}\ (m),$$

$$500(\mathrm{V})V1\leqq3000\ (\mathrm{V}),\text{ and}$$

$$500(\mathrm{V})V2\leqq3000\ (\mathrm{V}).$$

4. A developing apparatus according to claim 1 or 2, wherein an AC component waveform of the developing bias applied to said first developing member and said second developing member is a waveform in which a rectangular portion and a discontinued portion are alternately repeated.

5. A developing apparatus according to claim 1 or 2, wherein the same developing biases are applied to said first developing member and said second developing member by the said applying means.

6. An image forming apparatus comprising:

an image bearing member on which an electrostatic image is formed;

a developing apparatus for toner-developing the electrostatic image; and transferring means for transferring a toner-developed image to a sheet, said developing apparatus being a developing apparatus according to claim 1 or 2.

* * * * *

UNITED STATES PATENT AND TRADEMARK OFFICE

CERTIFICATE OF CORRECTION

PATENT NO. : 7,218,881 B2
APPLICATION NO. : 11/157820
DATED : May 15, 2007
INVENTOR(S) : Shigeru Tanaka It is certified that error appears in the above-identified patent and that said Letters Patent is hereby corrected as shown below:

COLUMN 1:
Line 67, "suffers from" should read --suffered from--.

COLUMN 3:
Line 10, "will becomes" should read --will become--.

COLUMN 8:
Line 18, "moving round" should read --moving around--.
Line 21, "moving round" should read --moving around--.

COLUMN 9:
Line 1, "and room" should read --and it is necessary to leave room-- and
Line 3, "developing roller 3B to be effected by left." should read --developing roller 3B.--.

COLUMN 10:
Line 3, "maintained good." should read --well maintained.--.

COLUMN 16:
Line 31, "V2 (v)," should read --V2 (V),--.

Signed and Sealed this

Eleventh Day of March, 2008

JON W. DUDAS
*Director of the United States Patent and Trademark Office*